US006467193B1

(12) United States Patent
Okajima

(10) Patent No.: US 6,467,193 B1
(45) Date of Patent: Oct. 22, 2002

(54) BOOT LINER

(75) Inventor: Shinpei Okajima, Izumi (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 09/921,315

(22) Filed: Aug. 3, 2001

(51) Int. Cl.[7] ..... A43B 3/10; A43B 17/10; A43B 5/04; A43B 23/07

(52) U.S. Cl. ..... 36/10; 36/50.5; 36/55; 36/50.1

(58) Field of Search ..... 36/10, 50.1, 50.5, 36/55, 89

(56) References Cited

U.S. PATENT DOCUMENTS

| | | | | |
|---|---|---|---|---|
| 1,386,985 A | * | 8/1921 | Bowers | |
| RE31,052 E | * | 10/1982 | Adams | |
| 4,670,998 A | * | 6/1987 | Pasternak | 36/50.1 |
| 4,989,350 A | * | 2/1991 | Bunch et al. | 36/114 |
| 5,042,120 A | * | 8/1991 | Nichols | 36/50.1 |
| 5,377,430 A | * | 1/1995 | Hatfield et al. | 36/50.1 |
| 5,469,640 A | * | 11/1995 | Nichols | |
| 5,575,090 A | * | 11/1996 | Condini | 36/10 |
| 5,909,946 A | * | 6/1999 | Okajima | |
| 5,933,987 A | * | 8/1999 | Demarchi | 36/10 |
| 5,937,542 A | * | 8/1999 | Bourdeau | |
| 6,073,370 A | * | 6/2000 | Okajima | |
| 6,119,372 A | * | 9/2000 | Okajima | |
| 6,230,423 B1 | * | 5/2001 | Donnelly | 36/10 |

FOREIGN PATENT DOCUMENTS

| | | | |
|---|---|---|---|
| DE | 1869303 | * | 3/1963 |
| EP | 0723746 A1 | * | 7/1996 |
| EP | 0937417 A2 | * | 8/1999 |
| EP | 0937418 A2 | * | 8/1999 |
| EP | 0995363 A1 | * | 4/2000 |
| FR | 616991 | * | 2/1927 |
| FR | 2699795 A1 | * | 7/1994 |
| FR | 2770379 A1 | * | 5/1999 |
| FR | 2785506 A1 | * | 5/2000 |
| JP | 2756650 B2 | * | 10/1996 |
| JP | 2000-189202 A | * | 7/2000 |
| WO | WO 91/08686 A1 | * | 6/1991 |
| WO | WO 98-06288 A1 | * | 2/1998 |

* cited by examiner

*Primary Examiner*—Anthony D. Stashick
(74) *Attorney, Agent, or Firm*—Shinjyu Global IP Counselors, LLP

(57) ABSTRACT

A boot liner basically includes a sole portion, an upper portion and a tightening device. A tongue is preferably mounted in a slit formed in the upper portion. The tightening device is coupled to the upper portion for drawing opposite lateral sides of the upper portion towards one another. The tightening device includes a plurality of primary lacing portions formed on the upper portion, a power strap with a secondary lacing portion coupled to the upper portion and lacing extending in a crossing pattern across the slit and between the primary lacing portions and the secondary lacing portion of the power strap. The power strap has a first end fixed on a first side of the opposite lateral sides and a second end with the secondary lacing portion slideably coupled on a second side of the opposite lateral sides.

26 Claims, 5 Drawing Sheets

BOOT LINER

BACKGROUND OF THE INVENTION

1. Field of the Invention

This invention generally relates to a boot liner. More specifically, the present invention relates a sport boot liner or snowboard boot liner with lacing to snugly secure the liner about the wearer's foot.

2. Background Information

Many cold weather footwear have an internal boot liner that is separate from the outer shell of the footwear. For example, hiking boots, ski boots, snowboard boots and the like often have a boot liner. The boot liner provides thermal insulation, shock absorption, comfort, etc. for the wearer's foot and/or the lower part of the wearer's leg. The boot liner is typically formed with a sole and an upper portion. The upper portion is often formed with a central opening or slit. Some times a tongue is formed on a lower end of the opening or slit, the tongue extending between the sides of the central opening or slit.

It is important to keep the liner in contact with the wearer's foot. Thus, the boot liner is sometimes provided with a tightening device. The tightening device is typically positioned on the sides of the central slit and usually includes loops or eyelets with a lace extending through the loops or eyelets. The lace typically extends through the loops or eyelets in a crisscross manner, e.g., going from side to side through the loops and eyelets. Typically the eyelets or loops are formed on opposite sides of the opening in equal numbers at equally spaced apart intervals, defining pairs of eyelets or loops. Boot liners are formed of a variety of materials such as woven fabrics, sponge like materials or rubber, or various combinations of these materials. Some boot liners are provided with a tightening device that can tighten the boot liner around wearer's foot.

One example of a boot liner with a tightening device is disclosed in U.S. Pat. No. 5,937,542, assigned to Solomon S. A. This patent discloses a tightening device for a boot liner that uses a single cord and a plurality of straps to tighten the boot liner about the wearer's foot. These tightening device of this patent does not provide any means to exert a higher tightening force on the straps adjacent the ankle of the wearer to bring flaps of the upper closer to one another and to tighten the liner on the foot.

When tightening the boot liner, the lower portions of the lace must typically be pulled tight near eyelets or loops separately from the tightening of the ends of the lace. Often a boot user must pull portions of the lace near a second or third set of eyelets tight and then successively move up the pairs of eyelets, grab the corresponding portions of the lace and tighten it further until the top or ends of the lace are finally tightened. Such an operation can be difficult, since the criss-cross configuration of the lace and friction make it very difficult to tighten the lace easily.

In view of the above, there exists a need for snowboard boot liner which overcomes the above mentioned problems in the prior art. This invention addresses this need in the prior art as well as other needs, which will become apparent to those skilled in the art from this disclosure.

SUMMARY OF THE INVENTION

One object of the present invention is to provide an article of footwear with a lace configuration, which is easier to tighten.

Another object of the present invention is to provide boot liner, which is securely tighten about the wears ankle.

Another object of the present invention is to provide snowboard boot liner, which uses a conventional criss-cross lacing pattern.

The foregoing objects can basically be attained by providing a snowboard boot liner comprising a sole portion, an upper portion and a tightening device. The upper portion has a foot section fixedly coupled to the sole portion and a leg section extending upwardly from the foot section, with a longitudinal slit formed along the leg section. The tongue portion coupled to the upper portion and arranged to span the slit formed in the leg section. The tightening device is coupled to the upper portion for drawing opposite lateral sides of the upper portion that define the slit towards one another. The tightening device includes a plurality of primary lacing portions formed on the upper portion, a power strap with a secondary lacing portion coupled to the upper portion and lacing extending in a crossing pattern across the slit and between the primary lacing portions and the secondary lacing portion of the power strap. The power strap has a first end fixed on a first side of the opposite lateral sides and a second end with the secondary lacing portion slideably coupled on a second side of the opposite lateral sides.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
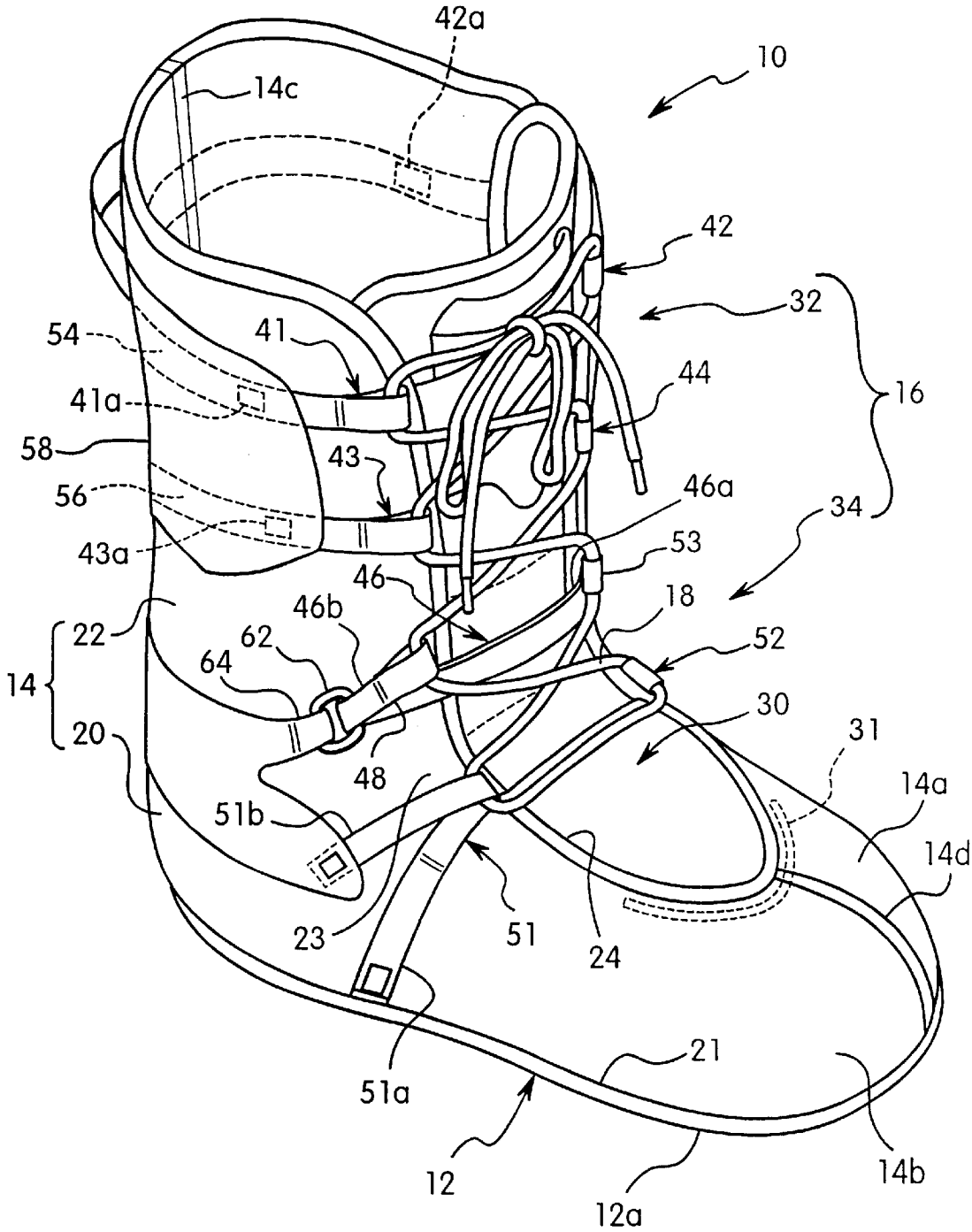
FIG. 1 is a side perspective view of a boot liner in accordance with the present invention.
Figure 2:
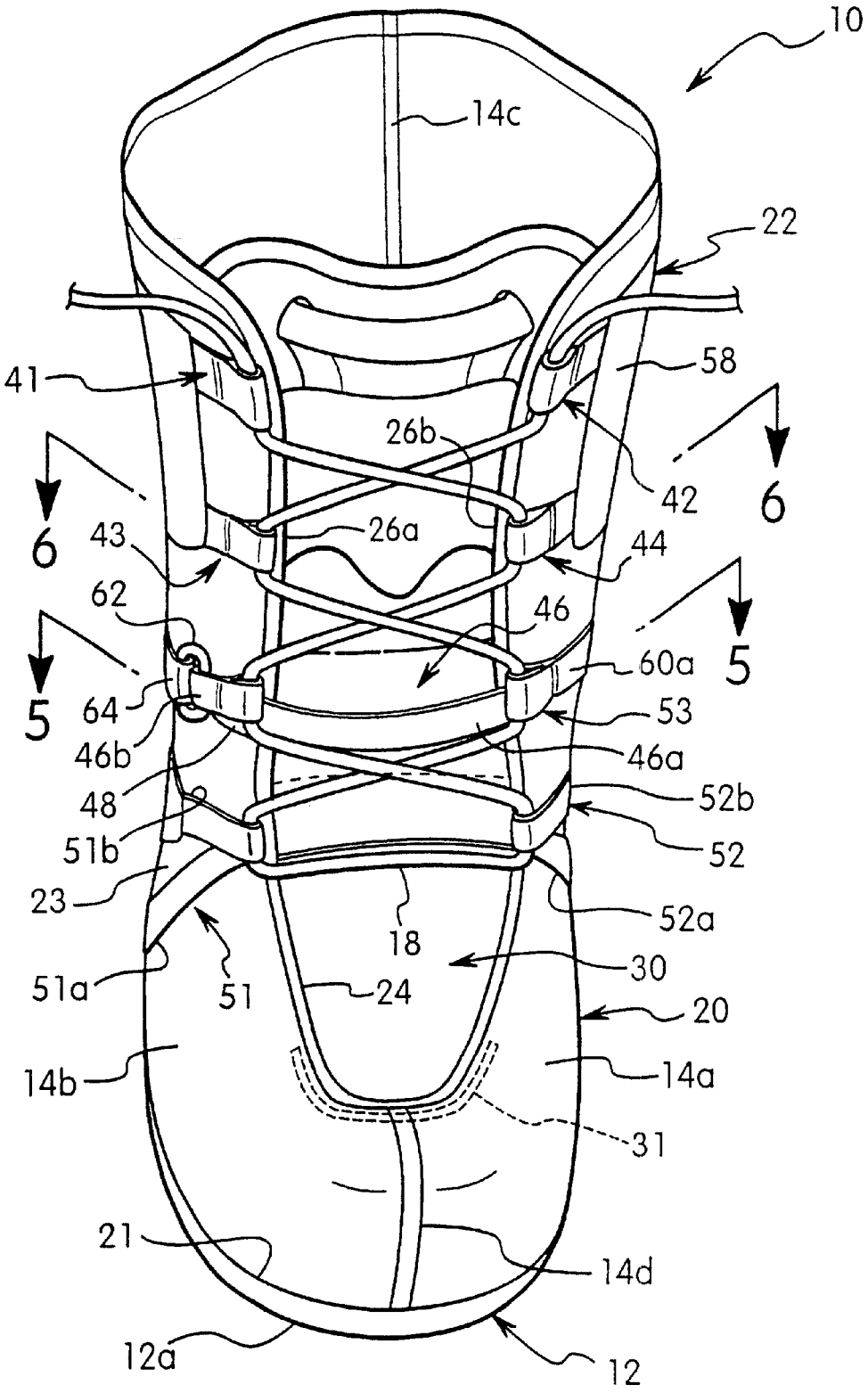
FIG. 2 is a front perspective view of the boot liner illustrated in FIG. 1.
Figure 3:
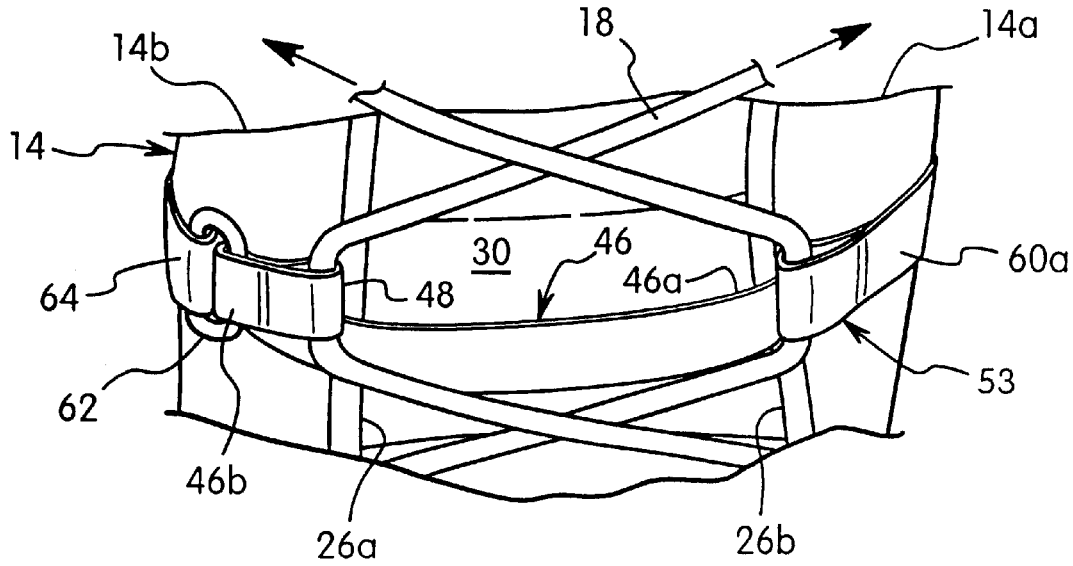
FIG. 3 is an enlarged, partial front perspective view of a portion of the boot liner illustrated in FIGS. 1 and 2, with a power strap shown prior to tightening.
Figure 4:
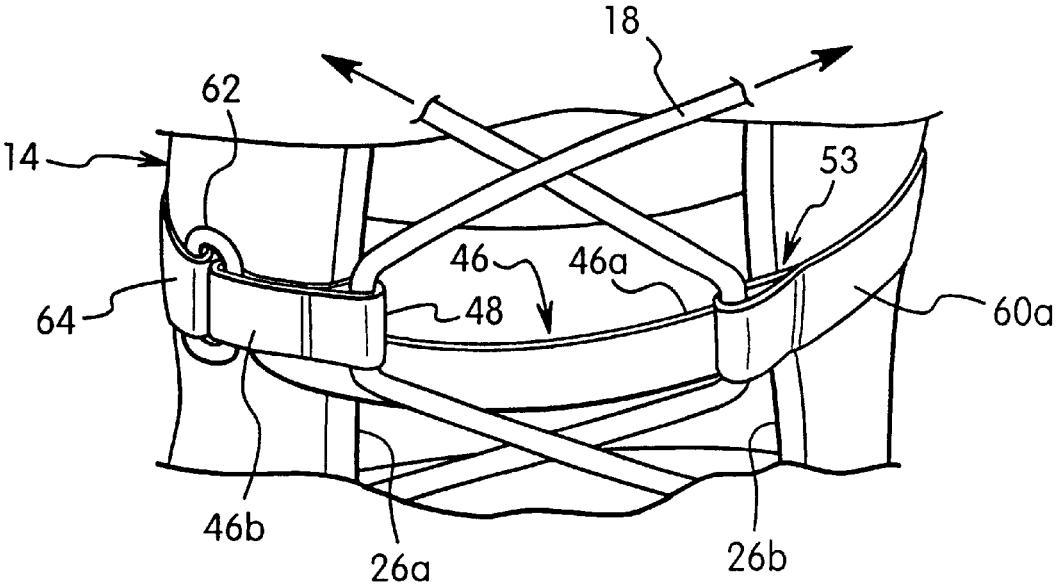
FIG. 4 is enlarged, partial front perspective view of a portion of the boot liner illustrated in FIGS. 1 and 2, with a power strap shown after tightening.

Referring initially to FIGS. 1 and 2, a boot liner 10 is illustrated in accordance with a preferred embodiment of the present invention. The boot liner 10 is preferably designed to be used with a sport boot (not shown) or the like. More specifically, the boot liner 10 is designed to be inserted into a shell of a sport boot such as a snowboard boot (not shown). The boot liner 10 allows for a tight fit around the foot and lower leg of the wearer. More specifically, the boot liner 10 of the present invention allows a tight fit around the ankle area of the wearer.

The boot liner 10 basically includes a sole portion 12, an upper portion 14 coupled to the sole portion 12 and a tightening device 16 coupled to the upper portion 14 for drawing opposite lateral sides of the upper portion 14 together via a lace or cord 18. As used herein, the following directional terms "forward, rearward, above, downward, vertical, horizontal, below and transverse" as well as any other similar directional terms refer to those directions of the boot liner 10 in the normal upright position. Accordingly, these terms, as utilized to describe the present invention should be interpreted relative to a wearer's foot with the boot liner 10 in the normal upright position. The sole portion 12 is preferably a separate member that is fixedly coupled to the upper portion 14 in a conventional manner such as by sewing the two portions together. The sole portion 12 is preferably constructed of a flexible material. The material of the sole portion 12 is preferably different from the upper portion 14. More specifically, the sole portion 14 should have a bottom surface 12*a* that has a higher coefficient of friction than the exterior surface of the upper portion 14. In other words, when the boot liner 10 is located within the boot (not shown) the sole portion 12 will frictionally contact the inner surface of the boot to limit relative movement therebetween. Preferably, the sole portion 12 is constructed of a flexible resilient rubber or ethylene-vinyl acetate copolymer (EVA). The bottom surface 12*a* of the sole portion 12 can be textured to increase the non-slip characteristics thereof. The sole portion 12 can be constructed of several pieces or layers as needed and/or desired. For example, the sole portion 12 can include a cushion section or layer overlies a rubber layer that forms the bottom surface 12*a*.

The upper portion 14 is preferably constructed of two halves or parts 14*a* and 14*b*. These halves or parts 14*a* and 14*b* are sewn together by stitching 14*c* and 14*d* to form a foot section 20 and a leg section 22. The foot section 20 is fixedly coupled to the sole portion 12 in a conventional manner, preferably by stitching 21. The leg portion 22 extends upwardly from the foot section 20 with a longitudinal slit 24 formed in both the foot section 20 and the leg section 22. The longitudinal slit 24 is substantially located along the middle or median plane of the boot liner 10. Thus, the longitudinal slit 24 is defined by a pair of opposite lateral sides 26*a* and 26*b* of the upper portion 14. Preferably, the longitudinal slit 24 extends along both the foot section 20 and the leg section 22.

Figure 5:
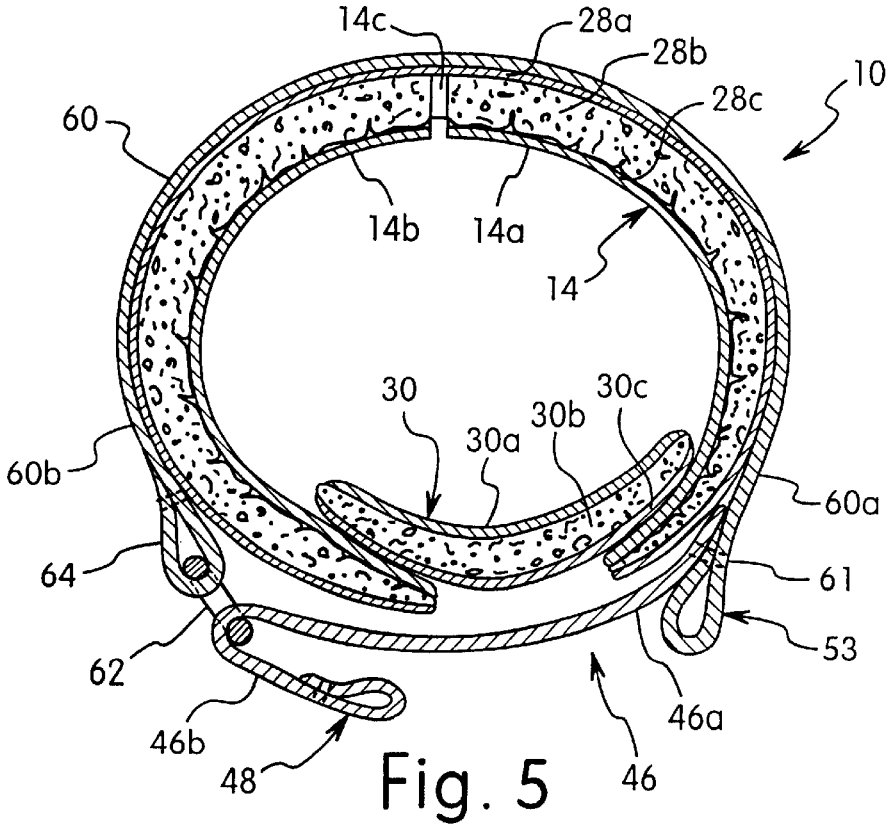
FIG. 5 is an enlarged, partial cross-sectional view of the boot liner illustrated in FIGS. 1–4 as viewed along section line 5—5 of FIG. 2.
Figure 6:
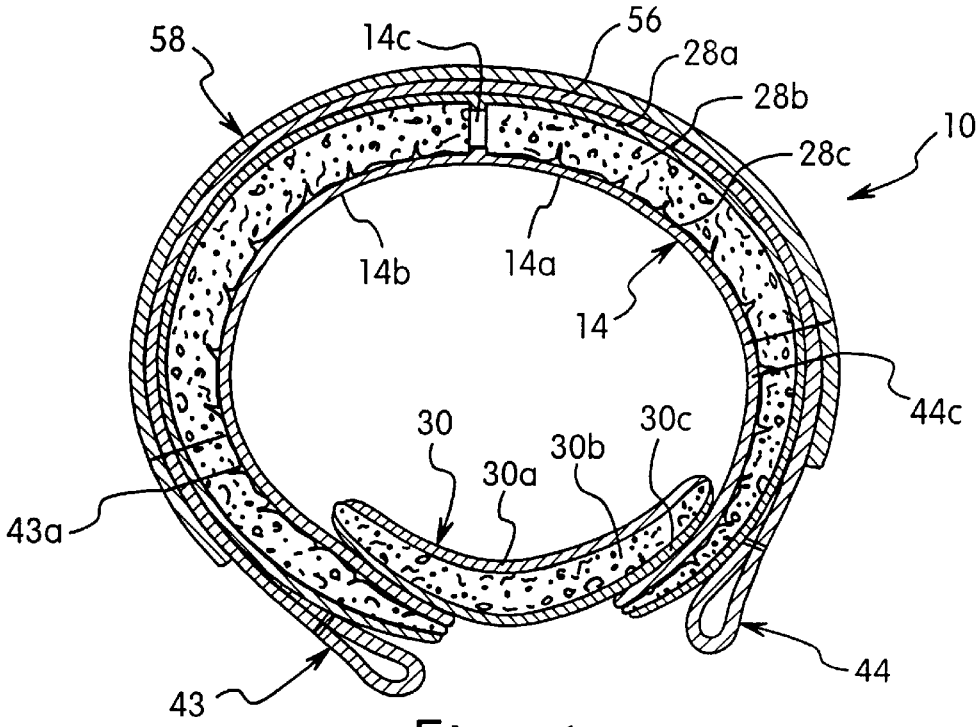
FIG. 6 is an enlarged, partial cross-sectional view of the boot liner illustrated in FIGS. 1–4 as viewed along section line 6—6 of FIG. 2.
Figure 7:
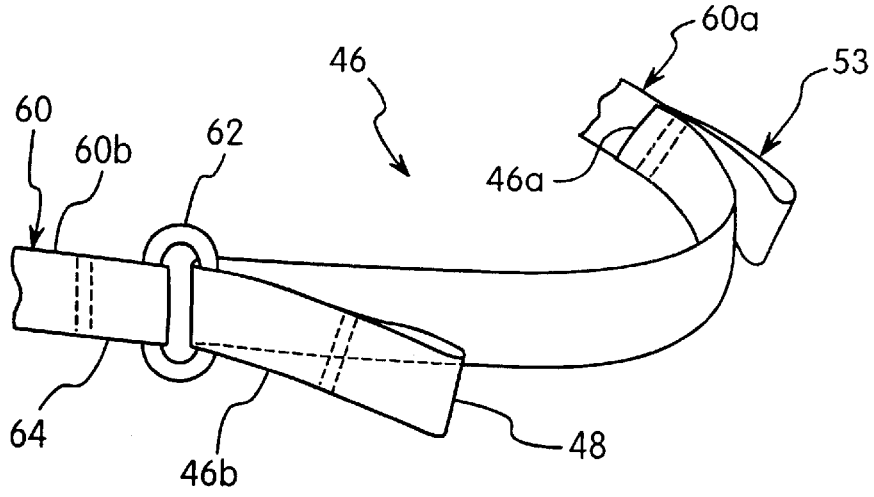
FIG. 7 is an enlarged, partial side perspective view of the power strap of the boot liner illustrated in FIGS. 1–5.
Figure 8:
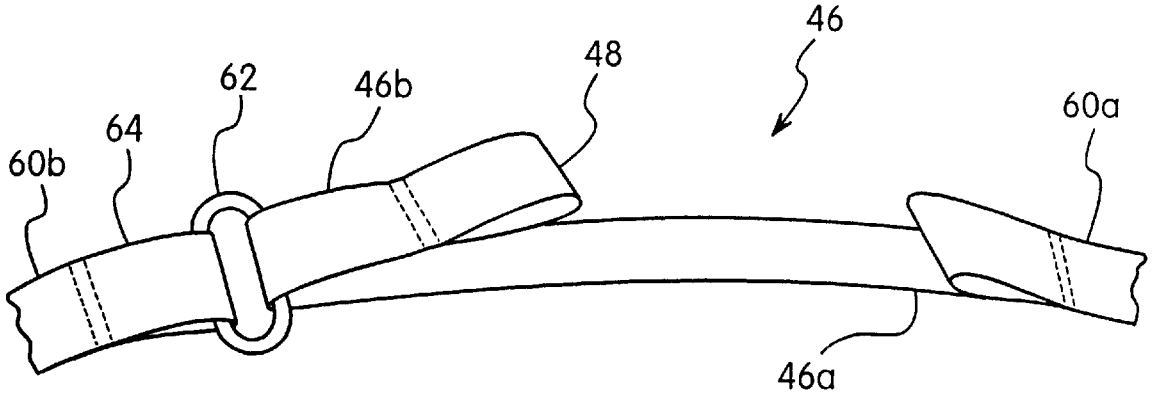
FIG. 8 is a front perspective view of the power strap illustrated in FIG. 7.

Each of the halves or parts 14*a* and 14*b* of the upper portion 14 is constructed of three layers of flexible materials as best seen in FIGS. 5 and 6. More specifically, the upper portion 14 has an outer layer 28*a*, a middle layer 28*b* and an inner layer 28*c*. This layered configuration is preferably bonded together in a conventional manner. For example, the outer layer 28*a* can be constructed of a starch-acrylamide graph copolymer (SPAN™). The intermediate layer 28*b* is preferably constructed of a foam or sponge material. The inner layer 28*c* is preferably constructed of a cloth material such as a NYLEX® polymer knit fabric. Of course, it will be apparent to those skilled in the art from this disclosure that the upper portion 14 can be is constructed of one or more layers of suitable flexible materials that will carry out the present invention.

A tongue portion 30 is fixedly coupled to the upper portion 14 in a conventional manner such as being sewn thereto by stitching 31. The tongue portion is arranged to span the longitudinal slit 24 as seen in FIGS. 5 and 6. The tongue is preferably constructed of three layers 30*a*, 30*b* and 30*c*. Preferably, the materials of the layers 30*a*, 30*b* and 30*c* corresponds to the same materials used for the layers 28*a*, 28*b* and 28*c* of the upper portion 14. Accordingly, the tongue portion 30 is constructed of a flexible cushioned material, which is preferably the same flexible cushioned material used for the upper portion 14. This layered configuration is preferably bonded together in a conventional manner.

The tightening device 16 is coupled to the upper portion 14 for drawing opposite lateral sides 26*a* and 26*b* of the upper portion 14 towards one another. The tightening device 16 basically includes an upper lacing member 32 and a lower lacing member 34. The upper lacing member 32 includes four (two pairs) of primary lacing portions 41, 42, 43 and 44, while the lower lacing member 34 includes a power strap or belt 46 with a secondary lacing portion 48 and three primary lacing portions 51, 52 and 53. The upper lacing member 32 primarily tightens the leg section 22 of the upper portion 14, while the lower lacing member 34 primarily tightens the ankle section 23, which is located at the intersection of the foot section 20 and the leg section 22. Of course, it will be apparent to those skilled in the art from this disclosure that depending upon the size of the boot liner 10 and its desired used, fewer or more primary lacing portions can be utilized to carry out the present invention.

The primary lacing portions 41–44 and 51–53 and the secondary lacing portion 48 are preferably constructed of conventional strap material that is commonly used in the art. Of course, a variety of arrangements can be utilized. For example, the primary lacing portions can be merely eyelets or holes formed directly in the upper portion 14. Alternatively, the primary lacing portions 41–44 and 51–53 and the secondary lacing portion 48 can be formed as hooks and/or rigid ring members. The tightening device 16 is positioned on the sides of the central slit 24 with the cord 18 extending through the looped members formed by the primary lacing portions 41–44 and 51–53 and the secondary lacing portion 48. The cord 18 typically extends through the looped members formed by the primary lacing portions 41–44 and 51–53 and the secondary lacing portion 48 in a criss-cross manner, e.g., going from side to side through the loops. Typically, the looped members formed by the primary lacing portions 41–44 and 51–53 and the secondary lacing portion 48 are located on opposite sides of the central slit 24 in equal numbers at equally spaced apart intervals so as to define pairs of looped members.

In the illustrated embodiment, the primary lacing portions 41–44 of the upper lacing member 32 is sewn directly to the upper portion 14 via stitching 41*a*, 42*a*, 4*a* and 44*a*. The primary lacing portions 41 and 42 form a first pair of opposed looped members that are oppositely positioned across the slit 24 are coupled together by a connecting member or strap 54 that extends along a rearwardly facing section of the upper portion 14 relative to the slit 24. The primary lacing portions 43 and 44 form a second pair of opposed looped members that are oppositely positioned across the slit 24 are coupled together by a connecting member or strap 56 that extends along a rearwardly facing section of the upper portion 14 relative to the slit 24.

In the preferred embodiment, a single strap is utilized to construct the connecting member 54 and the primary lacing portions 41 and 42. More specifically, the free ends of the connecting member 54 are looped and sewn to form two looped members or the primary lacing portions 41 and 42. Thus, the two primary lacing portions 41 and 42 and the connecting strap are integrally formed as a one-piece unitary member. The primary lacing portions 41 and 42 are coupled to the upper portion 14 by stitchings 41*a* and 42*a* which also secure the connecting member or strap 54 directly to the upper portion 14. The single strap utilized to construct the connecting member 54 and the primary lacing portions 41 and 42 is constructed of a flexible material such as leather, nylon or any other suitable material.

Similarly, a single strap is utilized to construct the connecting member 56 and primary lacing portions 43 and 44. The connecting member 56 and primary lacing portions 43 and 44 are sewn directly to the upper portion 14. In other words, the strap 56 and the primary lacing portions 43 and 44 are integrally formed from a single strap or belt which has its ends looped and sewn to form the looped members or primary lacing portions 43 and 44. The primary lacing portions 43 and 44 are coupled to the upper portion 14 by stitchings 43*a* and 44*a* which also secure the connecting member or strap 56 directly to the upper portion 14. The single strap utilized to construct the connecting member 56 and the primary lacing portions 43 and 44 is constructed of a flexible material such as leather, nylon or any other suitable material.

A reinforcing member 58 is secured to the upper portion 14 so as to overlie the connecting members or straps 54 and 56. Preferably, the reinforcing member 58 is constructed of a flexible material such as leather, nylon or any other suitable reinforcing material. The reinforcing member 58 can be adhesively attached to the upper portion 14 and the straps 54 and 56. Alternatively, the reinforcing member 58 can be sewn to the upper portion 14 and the straps 54 and 56. For example, stitching 41*a*–44*a* can be utilized to secure both the connecting members 54 and 56 and the reinforcing member 58 to the upper portion 14.

The primary lacing portions 51 and 52 of the lower lacing member 34 are preferably constructed of a pair of straps located on opposite sides of the longitudinal slit 24. The primary lacing portions 51 and 52 are connected together by a connecting member 60 that extends around the rearward facing section of the upper portion 14. In other words, the primary lacing portions 51 and 52 form a pair of opposed primary lacing portions or looped members. The primary lacing portion 51 is a looped member having a first end 51*a* fixedly coupled to the foot section 20 of the upper portion 14 and a second end 51*b* is fixedly coupled to one side of the connecting member 60 that extends around the rearward facing section of the upper portion 14. Similarly, the primary lacing portion 52 is a looped member having a first end 52*a* fixedly coupled to the foot section 20 of the upper portion 14 and a second end 52*b* fixedly coupled to the connecting member 60. Preferably, the ends of the primary lacing portions 51 and 52 sewn to the connecting member 60 and the foot section 20. The primary lacing portions 51 and 52 are constructed of a flexible material such as leather, nylon or any other suitable material.

The connecting member 60 is preferably a flexible member that extends around the rearwardly facing section of the upper portion 14. The connecting member 60 is constructed of a flexible material such as leather, nylon or any other suitable material. The connecting member 60 can be secured to the exterior surface of the upper portion 14 via adhesive or being sewn thereto. Alternatively, the connecting member 60 can be free floating so as to better conform to the wearer's foot during tightening of the tightening device 16. The connecting member 60 includes the power strap 46 and the primary lacing portion 53 so that the secondary lacing portion 48 is located opposite of the primary lacing portion 53 across the longitudinal slit 24. The connecting member 60 and the primary lacing portion 53 are integrally formed together as a one-piece, unitary member with the power strap 46 fixedly coupled thereto.

More specifically, the primary lacing portion 53 is formed by looping and sewing a portion of the connecting member 60 back upon itself to form a loop member at a point 60*a* of the connecting member 60. The power strap 46 has a first end 46*a* that is fixedly coupled to the connecting member 60 adjacent the primary lacing portion 53. More preferably, stitching 61 used to form the primary lacing portion 53 is also used to secure the first end 46*a* of the power strap 46 to the point 60*a* of the connecting member 60. The second end 46*b* of the power strap 46 has the secondary lacing portion 48 formed thereon. The second end 46*b* of the power strap 46 is slideably coupled to the connecting member 60 via a ring 62 that is secured to the connecting member 60 via a looped member 64 at a point 60*b* of the connecting member 60. The looped member 64 and the connecting member 60 are integrally formed together as a one-piece, unitary member. The looped member 64 is formed by looping and sewing a portion of the connecting member 60 back upon itself. Thus, the power strap 46 extends between points 60*a* and 60*b* of the connecting member 60. This arrangement of the power strap 46 provides a mechanical advantage so as to double the tightening force applied to the ankle section 23 of the upper portion 14 in comparison to the other pairs of looped members. In other words, less force needs to be applied to the cord 18 between the primary lacing portion 53 and the secondary lacing portion 48 to obtain a higher tightening force in comparison to the other pairs of looped members.

The lacing or cord 18 extends through the looped members formed by the primary lacing portions 41–44 and 51–53 and the secondary lacing portion 48 in a criss-cross pattern. In other words, the cord 18 is first looped around the primary lacing portions 51 and 52 and then the cord 18 criss-crosses to loop around the secondary lacing portion 48 and the primary lacing portion 53. The cord 18 then criss-crosses again so as to be looped through the primary lacing portions 43 and 44. The cord 18 is then again criss-crossed and looped around the primary lacing portions 41 and 42 such that the free ends of the cord 18 can be tied together.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A boot liner comprising:

a sole portion;

an upper portion having a foot section fixedly coupled to said sole portion and a leg section extending upwardly from said foot section, with a longitudinal slit formed along said leg section;

a tongue portion coupled to said upper portion and arranged to span said slit formed in said leg section; and a tightening device coupled to said upper portion for drawing opposite lateral sides of said upper portion that define said slit towards one another, said tightening device including a plurality of primary lacing portions formed on said upper portion, a power strap with a secondary lacing portion coupled to said upper portion and lacing extending in a crossing pattern across said slit and between said primary lacing portions and said secondary lacing portion of said power strap, said power strap having a first end fixed on a first side of said opposite lateral sides and a second end with said secondary lacing portion slideably coupled on a second side of said opposite lateral sides, said first end of said power strap being fixed to a connecting member and said second end of said power strap is slideably coupled to said connecting member that extends along a rearwardly facing section of said upper portion between said opposite lateral sides of said upper portion, said connecting member including a ring that slideably receives said second end of said power strap, one of said primary lacing portions being coupled to said first end of said power strap, said connecting member having an additional pair of said primary lacing portions coupled thereto.

2. The boot liner according to claim 1, wherein each of said additional primary lacing portions is formed of a strap member with one end coupled to said connecting member and another end coupled to said foot section.

3. A boot liner comprising:

a sole portion;

an upper portion having a foot section fixedly coupled to said sole portion and a leg section extending upwardly from said foot section, with a longitudinal slit formed along said leg section;

a tongue portion coupled to said upper portion and arranged to span said slit formed in said leg section; and a tightening device coupled to said upper portion for drawing opposite lateral sides of said upper portion that define said slit towards one another, said tightening device including a plurality of primary lacing portions formed on said upper portion, a power strap with a secondary lacing portion coupled to said upper portion and lacing extending in a crossing pattern across said slit and between said primary lacing portions and said secondary lacing portion of said power strap, said power strap having a first end fixed on a first side of said opposite lateral sides and a second end with said secondary lacing portion slideably coupled on a second side of said opposite lateral sides, said primary lacing portions including looped members, at least two of said looped members that are oppositely positioned across said slit being coupled together by a connecting strap that extends along a rearwardly facing section of said upper portion relative to said slit, said connecting strap is fixedly coupled to said upper portion, said upper portion including a reinforcing member coupled thereto with said connecting strap located between said upper portion and said reinforcing member.

4. A boot liner comprising:

a sole portion;

an upper portion having a foot section fixedly coupled to said sole portion and a leg section extending upwardly from said foot section, with a longitudinal slit formed along said leg section;

a tongue portion coupled to said upper portion and arranged to span said slit formed in said leg section; and a tightening device coupled to said upper portion for drawing opposite lateral sides of said upper portion that define said slit towards one another, said tightening device including a plurality of primary lacing portions formed on said upper portion, a power strap with a secondary lacing portion coupled to said upper portion and lacing extending in a crossing pattern across said slit and between said primary lacing portions and said secondary lacing portion of said power strap, said power strap having a first end fixed on a first side of said opposite lateral sides and a second end with said secondary lacing portion slideably coupled on a second side of said opposite lateral sides, said primary lacing portions including looped members, at least two pairs of said looped members that are oppositely positioned across said slit being coupled together by a pair of connecting straps that extend along a rearwardly facing section of said upper portion relative to said slit to couple opposing looped members together, said upper portion including a reinforcing member coupled thereto with said connecting straps located between said upper portion and said reinforcing member.

5. A boot liner comprising:

a sole portion;

an upper portion having a foot section fixedly coupled to said sole portion and a leg section extending upwardly from said foot section, with a longitudinal slit formed along said leg section;

a tongue portion coupled to said upper portion and arranged to span said slit formed in said leg section; and a tightening device coupled to said upper portion for drawing opposite lateral sides of said upper portion that define said slit towards one another, said tightening device including a plurality of primary lacing portions formed on said upper portion, a power strap with a secondary lacing portion coupled to said upper portion and lacing extending in a crossing pattern across said slit and between said primary lacing portions and said secondary lacing portion of said power strap, said power strap having a first end fixed on a first side of said opposite lateral sides and a second end with said secondary lacing portion slideably coupled on a second side of said opposite lateral sides, said power strap having an intermediate section extending between said first and second ends of said power strap that extends across said slit and said tongue portion.

6. The boot liner according to claim 5, wherein said second end of said power strap is slideably coupled to said second side of said opposite lateral sides by a ring that receives said second end of said power strap.

7. The boot liner according to claim 6, wherein said ring is coupled to a looped strap that is coupled to said upper portion.

8. The boot liner according to claim 7, wherein said secondary lacing portion is a looped member.

9. The boot liner according to claim 6, wherein one of said primary lacing portions is coupled adjacent said first end of said power strap.

10. The boot liner according to claim 5, wherein said first end of said power strap is fixed to a connecting member and said second end of said power strap is slideably coupled to said connecting member that extends along a rearwardly facing section of said upper portion between said opposite lateral sides of said upper portion.

11. The boot liner according to claim 10, wherein said connecting member includes a ring that slideably receives said second end of said power strap.

12. The boot liner according to claim 11, wherein said ring is coupled to said connecting member by a looped strap.

13. The boot liner according to claim 12, wherein said secondary lacing portion is a looped member.

14. The boot liner according to claim 11, wherein one of said primary lacing portions is coupled to said first end of said power strap.

15. The boot liner according to claim 5, wherein said primary lacing portions include looped members.

16. The boot liner according to claim 15, wherein at least two of said looped members that are oppositely positioned across said slit are coupled together by a connecting strap that extends along a rearwardly facing section of said upper portion relative to said slit.

17. The boot liner according to claim 16, wherein said connecting strap is fixedly coupled to said upper portion.

18. The boot liner according to claim 17, wherein said at least two looped members and said connecting strap are integrally formed as a one-piece unitary member.

19. The boot liner according to claim 15, wherein at least two pairs of said looped members that are oppositely positioned across said slit are coupled together by a pair of connecting straps that extend along a rearwardly facing section of said upper portion relative to said slit to couple opposing looped members together.

20. The boot liner according to claim 19, wherein each of said connecting straps is integrally formed with two of said looped members.

21. The boot liner according to claim 19, wherein each of said connecting strap is fixedly coupled to said upper portion.

22. The boot liner according to claim 5, wherein said sole portion is a separate member from said upper portion and is fixedly coupled to said foot section of said upper portion.

23. The boot liner according to claim 22, wherein said sole portion is constructed of a different material than said upper portion.

24. The boot liner according to claim 23, wherein said sole portion is constructed of a flexible rubber material.

25. The boot liner according to claim 5, wherein said upper portion is constructed of a flexible cushioned material.

26. The boot liner according to claim 25, wherein said upper portion is constructed of at least two different materials bonded together in a layered configuration.

* * * * *